US006222357B1

(12) United States Patent
Sakuragi

(10) Patent No.: US 6,222,357 B1
(45) Date of Patent: Apr. 24, 2001

(54) CURRENT OUTPUT CIRCUIT WITH CONTROLLED HOLDOVER CAPACITORS

(75) Inventor: Takamasa Sakuragi, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/389,362

(22) Filed: Sep. 3, 1999

(30) Foreign Application Priority Data

Sep. 7, 1998 (JP) ..... 10-253034

(51) Int. Cl.[7] ..... G05F 3/16; G05F 3/20
(52) U.S. Cl. ..... 323/315; 323/316
(58) Field of Search ..... 323/315, 316, 323/312, 313, 314

(56) References Cited

U.S. PATENT DOCUMENTS

| | | | | |
|---|---|---|---|---|
| 4,573,005 | * | 2/1986 | van de Plassche | 323/315 |
| 4,703,249 | * | 10/1987 | De La Plaza et al. | 323/316 |
| 4,716,305 | | 12/1987 | Sakuragi et al. | 307/196 R |
| 5,023,110 | | 6/1991 | Nomura et al. | 427/49 |
| 5,057,682 | * | 10/1991 | Michon et al. | 250/214 C |
| 5,627,111 | | 5/1997 | Tsukamoto et al. | 438/20 |
| 5,637,992 | * | 6/1997 | Edwards | 323/315 |
| 5,654,629 | * | 8/1997 | Theus | 323/316 |
| 5,880,639 | | 3/1999 | Sakuragi | 330/255 |

* cited by examiner

*Primary Examiner*—Peter S. Wong
*Assistant Examiner*—Bao Q. Vu
(74) *Attorney, Agent, or Firm*—Fitzpatrick, Cella, Harper & Scinto

(57) ABSTRACT

A current output circuit capable of reducing a variation in output channel currents, making small an occupied area in an integrated semiconductor chip, and shortening a time required for setting an output current. The current output circuit has a single reference current source, a plurality of current supply circuits each being constituted of a current mirror circuit made of a pair of MOS transistors and a hold capacitor, an operational amplifier, and a plurality of switching devices for selecting the current supply circuits in accordance with a load. The operational amplifier controls through feedback so that a current sampled by the current supply circuit becomes equal to the predetermined reference current to supply a drive current corresponding to the sampled current to each load.

10 Claims, 4 Drawing Sheets

CURRENT OUTPUT CIRCUIT WITH CONTROLLED HOLDOVER CAPACITORS

BACKGROUND OF THE INVENTION

1. Field of the Invention

The present invention relates to a current output circuit for sampling predetermined reference current and outputting current corresponding to sampled current, and more particularly to a current output circuit suitable for use as a drive circuit for a plurality of light emitting elements of a display or the like.

2. Related Background Art

In a conventional display for displaying characters and images which display has a number of light emitting elements such as light emitting diodes (hereinafter called an LED), for example, as shown in FIG. 3, a constant current circuit is constituted of D/A converters B1, B2, . . . corresponding to LED elements D1, D2, . . . Each LED element is supplied with a predetermined drive current via a corresponding one of current output terminals T1, T2, . . . of the D/A converters to drive the LED element. The light emission amount of the LED element changes with the drive current of the D/A converter. Each D/A converter is of a current output type. The output current of each D/A converter is determined by digital data set to the D/A converter and input reference voltages at terminals Vref(+) and Vref(−), where Vref(+) is a high reference voltage input terminal and Vref(−) is a low reference voltage input terminal.

FIG. 4 is a circuit diagram of a usual D/A converter B of a current output type. In FIG. 4, A1 represents an operational amplifier, Rf represents a feedback resistor used for converting input reference voltages Vref(+) and Vref(−) into current, Q1, Q2, . . . represent NPN transistors constituting a constant current circuit with binary weight, R1, R2, . . . represent resistors, S1, S2, . . . represent switching devices, and T represents and output terminal.

A problem associated with the driver circuit for multi-channel LED elements shown in FIG. 3 and using current output type D/A converters shown in FIG. 4, is a variation in output current values at respective channels. A variation in output current values is greatly influenced by a variation in resistance values of the feedback resistors Rf. As the number of output channels of an multi-channel LED element driver circuit made of a semiconductor integrated circuit increases, the variation in output current values increases. In order to reduce the variation, it is necessary to adjust the resistance value of each feedback resistor Rf through laser trimming or the like, so that the manufacture cost rises. Since it is necessary to provide D/A converters as many as the number of channels, the area of a wafer or chip occupied by the integrated circuit increases necessarily.

As an alternative multi-channel LED element driver circuit, a circuit such as shown in FIG. 5 may be used in which one current source (DAC) is used and switching devices and sampling circuits with capacitors are incorporated. In FIG. 5, DAC represents a current output type D/A converter, M1, M2, M3, . . . represent PMOS transistors constituting constant current circuits, S1, S2, S3, . . . and C1, C2, C3, . . . represent switching devices and capacitors constituting sample-hold circuits, D1, D2, D3, . . . represent light emitting elements such as LED, and reference numeral 1 represents a power source terminal.

In operation of this circuit, first the switching devices S1 and S4 are turned on and the other switching devices are tuned off to charge the hold capacitor C1 with an output current of DAC. The charge voltage of the capacitor C1 is determined by the output current of DAC and the characteristics of a gate source voltage $V_{GS}$ versus a drain current $I_D$ of the PMOS transistor M1. In accordance with this voltage, the other transistor M2 constituting a current mirror circuit together with the transistor M1 drives the light emitting element with constant current. Similarly, when the switching devices S1 and S4 are turned off and the switching devices S2 and S5 are turned on, the hold capacitor C2 is charged and, in accordance with this charge voltage, the transistor M4 drives the light emitting element D2 with constant current.

Since only one DAC of the circuit shown in FIG. 5 determines the output current of each channel, a variation in output currents as in the drive circuit using a number of DAC's shown in FIG. 3 does not exist. However, relative precisions of the transistors M1 and M2 and resistors R1, R2, the transistors M3 and M4 and resistors R3 and R4, and the like respectively constituting the current mirror circuit may cause the output current variation. However, since elements of this circuit can be disposed near each other, a current variation can be reduced more than the circuit shown in FIG. 3.

With the circuit shown in FIG. 5, however, as a high speed sample/hold operation is performed, a variation in output currents becomes large. The reason for this is as follows. The charge speed of the hold capacitor is determined by the capacitance of the capacitor and the output current of DAC. The charge speed is further dependent upon the output current of DAC. As the capacitance of the capacitor is made smaller, a hold voltage called a hold step generated when the switching devices S4 to S6 are turned off becomes larger. Therefore, a variation in output currents of the transistors M2, M4, M6, . . . constituting the constant current circuits becomes large relative to the output current set to DAC.

The discharge speed of the hold capacitor is determined by the mutual conductance $g_m$ of the PMOS transistor M1, M3, M5, . . . whose gate and drain are short-circuited. The mutual conductance $g_m$ is dependent upon a ratio (W/L) of the gate width W to the gate length L of each transistor. It is necessary to increase the mutual conductance and hence the gate width W in order to speed up the discharge speed of the hold capacitor.

However, if the gate width of the PMOS transistor M1, M2, M3, . . . is increased, the area occupied in an integrated circuit necessarily increases and at the same time a parasitic capacitor of the drain formed between the drain and semiconductor substrate or the like becomes large. This parasitic capacitance is multiplied by the number of output channels. Therefore, the parasitic capacitance hinders the high speed sample/hold operation. The precision of the current mirror circuit shown in FIG. 5 is also degraded by an unbalance of the drain-source voltages $V_{DS}$ of a pair of transistors constituting the current mirror circuit. This also causes a variation in output currents.

SUMMARY OF THE INVENTION

It is an object of the present invention to provide a current output circuit capable of setting an output current at high speed and with high precision, reducing a variation in output currents of respective channels, and reducing an area of the circuit occupied in a semiconductor integrated chip.

According to one aspect of the present invention, a current output circuit is provided which comprises: a plurality of current mirror circuits, each of the current mirror circuits including a pair of MOS transistors with gate electrodes being connected in common, and a main electrode of one of the pair of MOS transistors being connected to a current output terminal; a plurality of hold capacitors each connected to the gate electrodes of the current mirror circuit; a reference current source being selectively connected to the other of the pair of MOS transistors of the current mirror circuit; and an operational amplifier whose output terminal is selectively connected to the gate electrodes of each selected current mirror circuit and whose one of a pair of input terminals is connected to a main electrode of the other of the pair of MOS transistors of each selected current mirror circuit, to form a feedback loop.

The current output circuit may further comprises: a sampling switch for selectively connecting the reference current source to the main electrode of the other of the pair of MOS transistors of one of the plurality of current mirror circuits; and a feedback loop forming switch for selectively connection the output terminal of the operational amplifier to the gate electrodes of the selected current mirror circuit, wherein the feedback loop including at least the selected current mirror circuit is formed in the operational amplifier.

According to another aspect of the present invention, a current output circuit is provided which comprises: a reference current source for outputting a predetermined reference current; a plurality of current supply circuits provided for each of a plurality of current outputs, the current supply circuit including a current mirror circuit made of a pair of MOS transistors whose gate electrodes are connected in common, and a hold capacitor for holding a gate potential of the current mirror circuit, wherein one of the pair of MOS transistors samples the reference current and the other of the pair of MOS transistors supplies a drive circuit to a load; an operational amplifier whose non-inverting input terminal is input with a predetermined reference voltage, whose inverting input terminal is input with an output voltage of the one of the pair of MOS transistors of the current mirror circuit, the output voltage being fed back via a feedback resistor, and whose output terminal is connected to the gate electrodes of the current mirror circuit; and a plurality of switching devices for selecting the plurality of current supply circuits in accordance with each load, wherein the operational amplifier controls so that a current sampled by the current supply circuit becomes equal to the predetermined reference current to supply the drive current corresponding to the sampled current to each load.

DETAILED DESCRIPTION OF THE PREFERRED EMBODIMENTS

Figure 1:
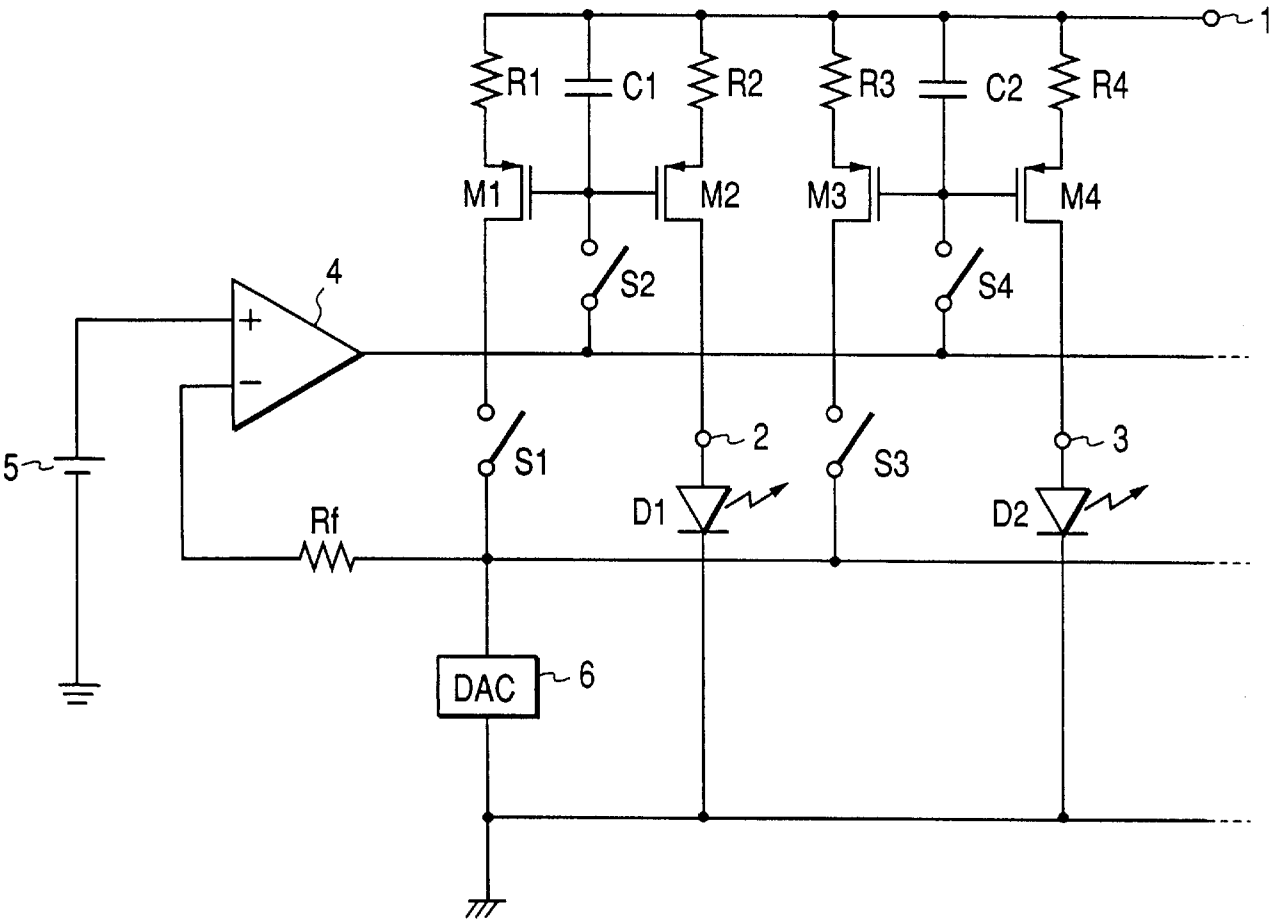
FIG. 1 is a circuit diagram of a current output circuit according to an embodiment of the invention.

Embodiments of the invention will be described in detail with reference to the accompanying drawings. FIG. 1 is a circuit diagram of a current output circuit according to an embodiment of the invention. In FIG. 1, M1 and M2 represent a pair of PMOS transistors whose gate terminals (gate electrodes) are connected in common, and C1 represents a hold capacitor for sampling/holding an output current of a current output type D/A converter 6. The hold capacitor C1 is connected between the gate terminal of the transistor and a power source terminal 1. The pair of PMOS transistors M1 and M2 constitute a current mirror circuit. S1 and S2 represent switching devices, R1 and R2 represent resistors, and D1 represents a load to be driven. The load is a light emitting element such as an LED, a semiconductor laser and an electron emission element.

Of the pair of transistors M1 and M2, the transistor M1 has a drain terminal as its main electrode which is connected via the switching device S1 to the D/A converter 6, and the other transistor M2 has a drain terminal as its main electrode which is connected via an output terminal 2 to the light emitting element D1. Namely, the transistor M1 samples an output current of the D/A converter 6 and the transistor M2 supplies a drive current corresponding to the sampled current to the load or light emitting element D1. The gate terminals of the pair of transistors M1 and M2 are connected via the switching device 2 to an output terminal of an operational amplifier 4. The pair of transistors M1 and M2, hold capacitor C1, resistors R1 and R2 and switching devices S1 and S2 constitute the current output circuit for one channel. The switching device may be a circuit made of one or a plurality of transistors.

M3 and M4 represent PMOS transistors, C2 represents a hold capacitor, R3 and R4 represent resistors, S3 and S4 represent switching devices, and D2 represents a light emitting element. A pair of transistors M3 and M4 constitute a current mirror circuit. Of the pair of transistors M3 and M4, the transistor M3 has a drain terminal which is connected via the switching device S3 to the output terminal of the D/A converter 6, and the other transistor M4 has a drain terminal which is connected via an output terminal 3 to the light emitting element D2. The gate terminals of the pair of transistors M3 and M4 are connected via the switching device 4 to the output terminal of the operational amplifier 4. The pair of transistors M3 and M4, hold capacitor C2, resistors R3 and R4 and switching devices S3 and S4 constitute the current output circuit for one channel.

The operational amplifier 4 is of a current feedback type. A predetermined reference voltage is supplied from a bias voltage source 5 to a non-inverting input terminal (+) of the operational amplifier 4, and one end of a feedback resistor Rf is connected to an inverting input terminal (−) of the operational amplifier 4. The other end of the feedback resistor Rf is connected to the interconnections between the D/A converter 6 and switching devices S1 and S3. As described above, the output terminal of the operational amplifier 4 is connected to one ends of the switching devices S2 and S4. As a current flows out of the inverting input terminal (−), the output voltage of the operational amplifier 4 lowers. The inverting input terminal (+) has a high input impedance similar to a usual current feedback type operational amplifier.

The D/A converter 6 is a current output type D/A converter described earlier and outputs a predetermined reference current. The current output type D/A converter 6 is used as a reference current source of the predetermined reference current which is sampled at each channel of the current output circuit. Only two channels are shown as the current output circuit of FIG. 1. In practice, the current output circuit has a plurality of channels same as the number of light emitting elements to be driven, each channel being constituted of a pair of transistors, a hold capacitor, resistors and switching devices, and supplies a drive current to each light emitting element.

This embodiment is suitable for driving a flat panel display having a plurality of light emitting elements for displaying characters and images corresponding to input image data. Light emitting elements to be driven are selected by switching devices and supplied with drive current to display characters, images or the like. The switching devices S1 and S2 and the switching devices S3 and S4 are respectively paired and each pair of switching devices is controlled at the same time to be turned on and off in response to a control signal corresponding to image data supplied from an unrepresented switching control circuit.

Next, the operation of the embodiment will be described. For example, it is assumed that the switching devices S1 and S1 are turned on in response to a control signal from the unrepresented switching control circuit, and the other switching devices are tuned off. In this case, when the switching devices S1 and S2 are turned on, the PMOS transistor M2 enters a tracking state to output a current corresponding to the output current of the current output type D/A converter 6. At this time, the drain voltage of the transistor M1 is fed back to the inverting input terminal (−) of the operational amplifier 4 via the feedback resistor Rf, whereas the predetermined reference voltage of the voltage source 5 is applied to the non-inverting input terminal (+). Therefore, the operational amplifier 4 operates to make the drain voltage of the transistor M1 be equal to the predetermined reference voltage.

If the drain current of the transistor M1 is smaller than the output current of the D/A converter 6, the drain voltage of the transistor M1 lowers. In this case, since the inverting input terminal (−) of the operational amplifier 4 is driven in a low impedance state at the voltage generally equal to that at the non-inverting input terminal (+), a current flows through the feedback resistor Rf to make a current flow into the D/A converter 6. As a result, the output voltage of the operational amplifier 4, i.e., the gate voltage of the transistors M1 and M2, lowers. The drain current of the transistor M1 is therefore increased until it becomes that the current hardly flows through the feedback resistor Rf of the operational amplifier 4 having a sufficiently high gain. At this stable state, the drain current of the transistor M1 becomes equal to the output current of the D/A converter 6.

Since the transistors M1 and M2 constitute a current mirror circuit, the drain current of the other transistor M2, i.e., the current at the output terminal 2, is equal to the output current of the D/A converter 6. When the switching devices S1 and S2 are thereafter turned off, the gate voltage of the transistors M1 and M2 is held by the hold capacitor C1 and the current set to the transistor M1 in the manner described above is supplied as the drive current to the light emitting element D1 via the output terminal 2. When the switching devices S3 and S4 are turned on, in quite the similar manner described above, the circuit operates so that the drain current of the transistor M4 becomes equal to the output current of the D/A converter and the drive current is supplied to the load or light emitting element D2 via the output terminal 3.

In this embodiment, the negative feedback loop formed when the switching devices S1 and S2, or S3 and S4 are turned on, is balanced when the current flowing through the feedback resistor Rf becomes nearly 0, i.e., when the voltage across the input and output terminals of the current feedback type operational amplifier 4 becomes 0. Therefore, the drain voltage of the transistor M2 or M4 becomes eventually equal to the predetermined reference voltage of the voltage source 5 applied to the non-inverting input terminal (+) of the operational amplifier 4. Since the voltage across the light emitting element D1, D2 is already known, it is preferable to set the reference voltage of the voltage source 5 to the already known voltage across the light emitting element, in order to supply the drive current from the transistor M2, M4 to the light emitting element D1, D2 via the output terminal 2, 3.

Since the drain voltage of the transistor M1, M3 can be made equal to the voltage at the output terminal 2,3, a current mirror ratio can be prevented from being degraded, which depends on the drain-source voltage $V_{DS}$ of the transistor pair. It is therefore possible to suppress a variation in the output currents of light emitting elements and realize a high precision current output circuit.

Figure 2:
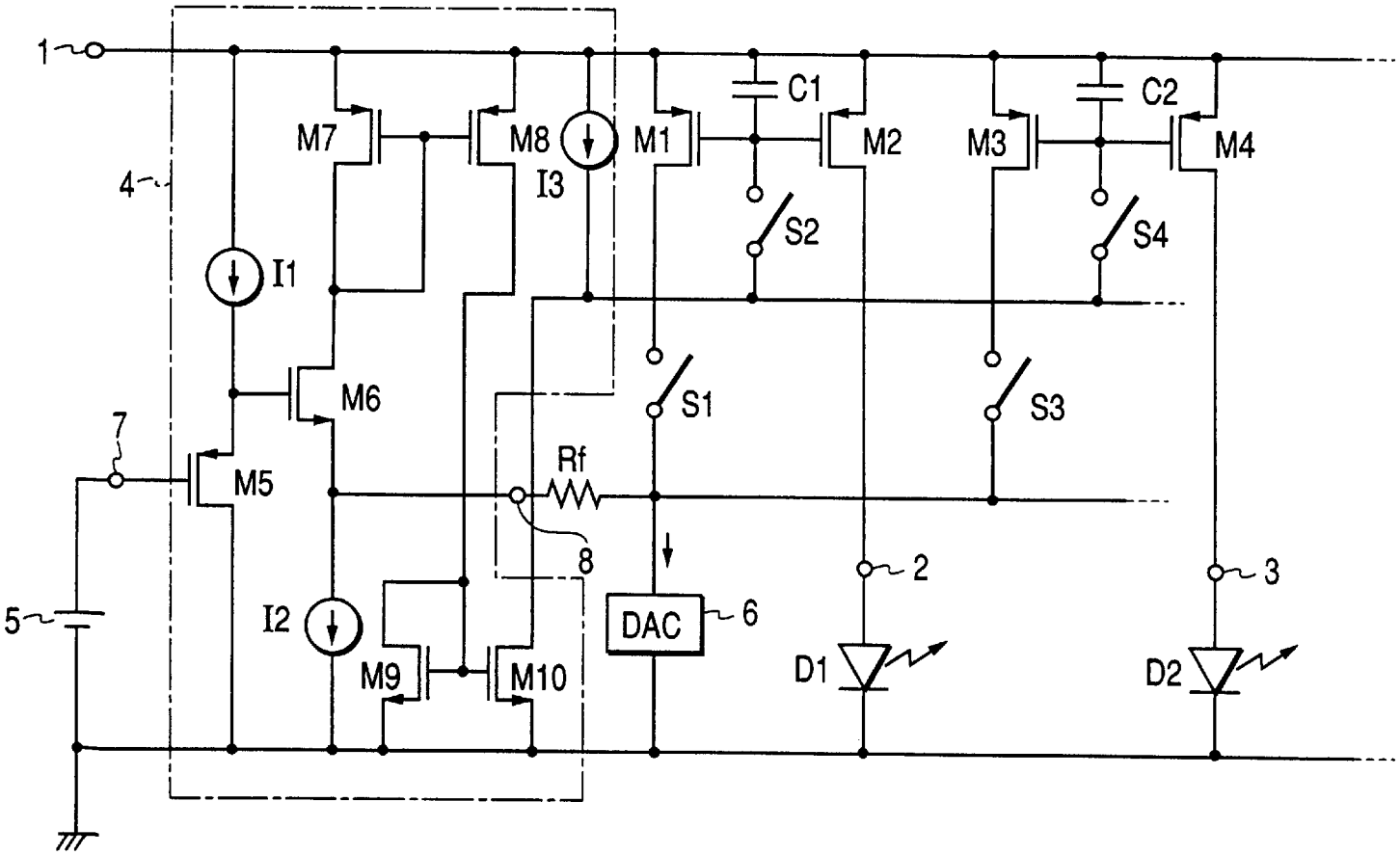
FIG. 2 is a circuit diagram showing an example of a current feedback type operational amplifier of the embodiment shown in FIG. 1.
Figure 3:
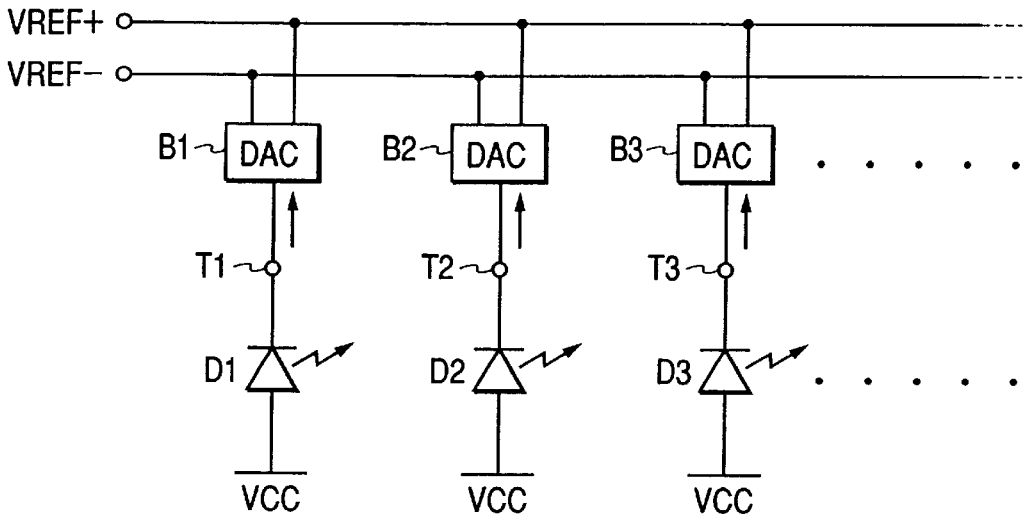
FIG. 3 PRIOR ART
FIG. 3 is a circuit diagram showing a conventional drive circuit for driving light emitting elements.
Figure 4:
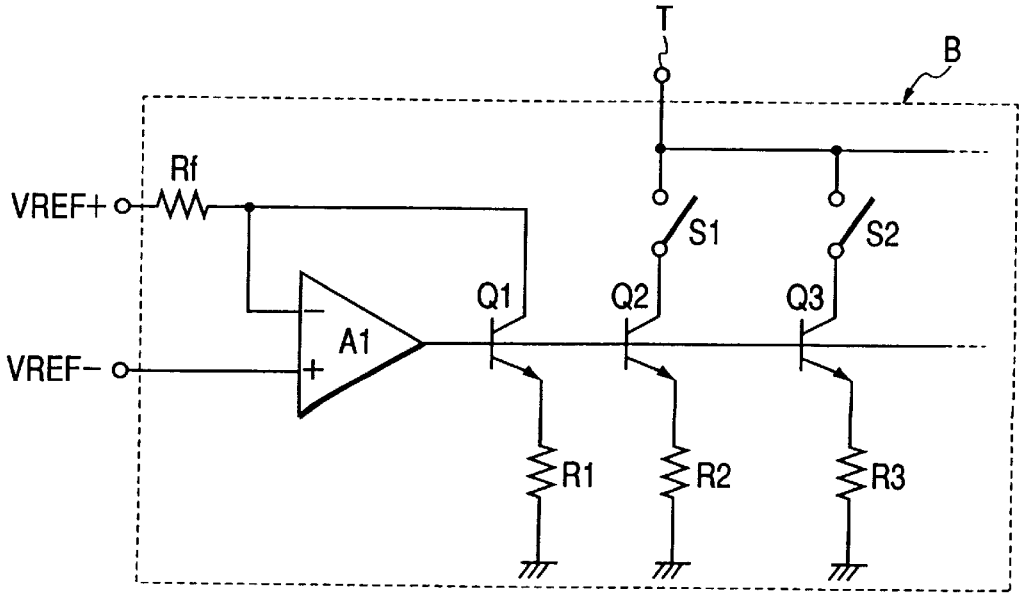
FIG. 4 PRIOR ART
FIG. 4 is a circuit diagram showing the details of a D/A converter shown in FIG. 3.
Figure 5:
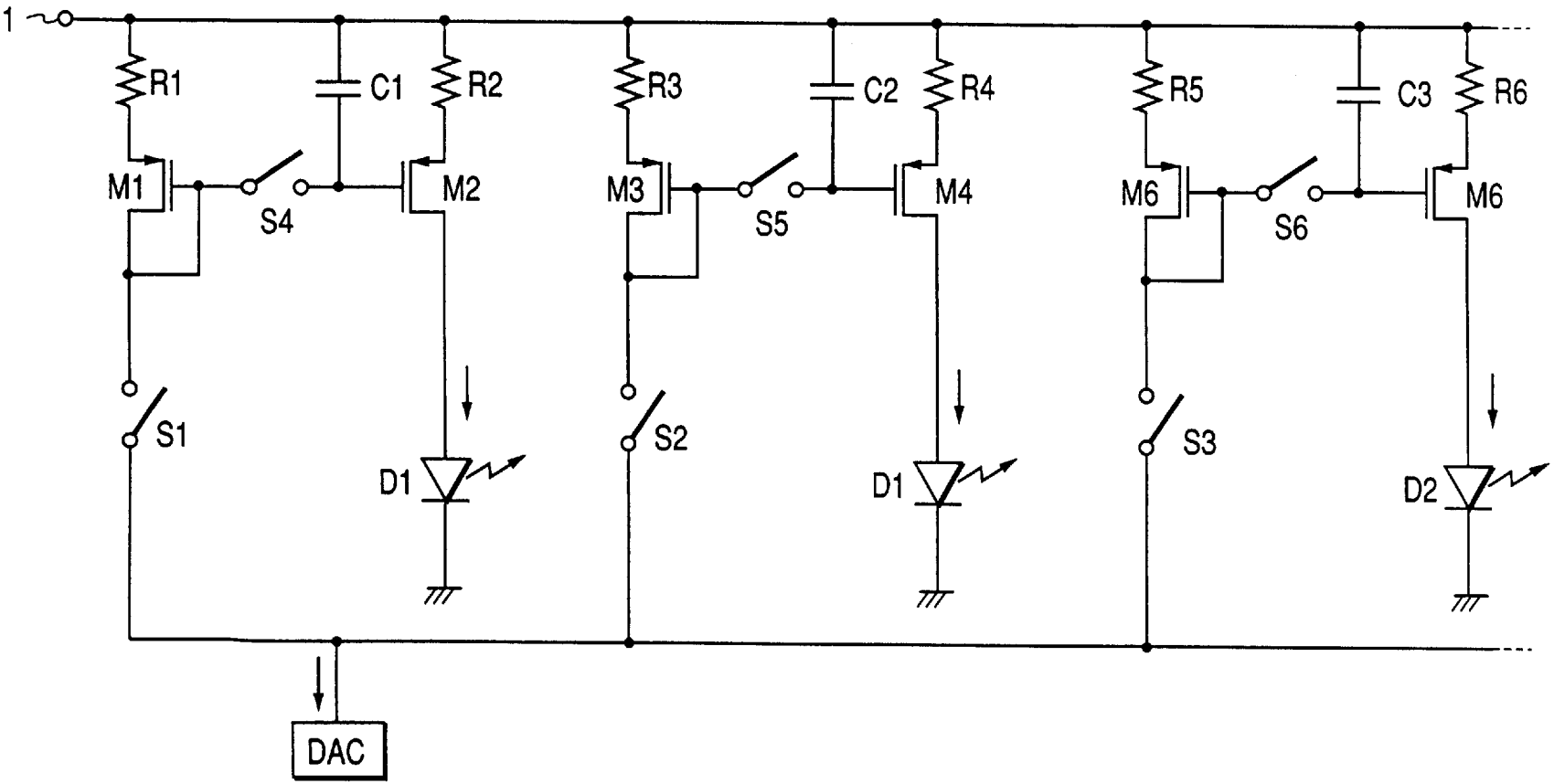
FIG. 5 is a circuit diagram showing an example of a drive circuit for driving light emitting elements.

FIG. 2 is a circuit diagram showing an example of the current feedback type operational amplifier 4 used by the circuit shown in FIG. 1. In FIG. 2, a terminal 7 corresponds to the non-inverting input terminal (+) of the operational amplifier 4, and a terminal 8 corresponds to the inverting input terminal (−) thereof. I1, I2 and I3 represent constant current bias sources, M5, M6, M7, M8, M9 and M10 represent PMOS or NMOS transistors for amplification. The current feedback type operational amplifier 4 is structured by using such components. As the operational amplifier 4, various known circuits may also be used.

The current output circuit of this invention is suitable for use with a drive circuit chip for a display with surface conduction electron emission elements disclosed in U.S. Pat. Nos. 5,023,110, 5,627,111 or the like.

The advantageous effects of the invention are enumerated as in the following.

(1) Only one reference current source for setting an output current is used, and only the current mirror circuit having a pair of transistors is required to have a small variation in component precisions. Accordingly, as compared to a conventional circuit which requires current sources for setting output currents as many as the number of output channels, a variation in channel output currents can be reduced considerably.

(2) The output current is positively set through feedback using the operational amplifier. Accordingly, as compared to a conventional circuit which passively sets output currents, the time required for setting the output current can be shortened.

(3) Since only one reference current source is used for setting an output current, the number of components per channel can be reduced and the circuit area occupied in a semiconductor integrated circuit can be made small, and the circuit can be manufactured with a small cost.

(4) Since the reference voltage of the operational amplifier is set equal to the voltage across the load, current can be sampled under the condition that the voltages between main electrodes of a pair of transistors constituting a current mirror circuit, i.e., the drain-source voltages, are equal. It is therefore possible to improve the precision of an output circuit considerably.

What is claimed is:

1. A current output circuit comprising:

a plurality of current mirror circuits, each of said current mirror circuits including a pair of MOS transistors with gate electrodes being connected in common, and a main electrode of one of the pair of MOS transistors being connected to a current output terminal;

a plurality of hold capacitors each connected to the gate electrodes of said current mirror circuit;

a reference current source being selectively connected to the other of the pair of MOS transistors of said current mirror circuit; and an operational amplifier whose output terminal is selectively connected to the gate electrodes of each selected current mirror circuit and whose one of a pair of input terminals is connected to a main electrode of the other of the pair of MOS transistors of each selected current mirror circuit, to form a feedback loop.

2. A current output circuit according to claim 1, further comprising:

a sampling switch for selectively connecting said reference current source to the main electrode of the other of the pair of MOS transistors of one of said plurality of current mirror circuits; and a feedback loop forming switch for selectively connection the output terminal of said operational amplifier to the gate electrodes of the selected current mirror circuit, wherein the feedback loop including at least the selected current mirror circuit is formed in said operational amplifier.

3. A current output circuit according to claim 1, wherein said reference current source is a D/A converter.

4. A current output circuit according to claim 2, wherein the feedback loop includes a feedback resistor.

5. A current output circuit according to claim 1, wherein the current output terminal is connected to a light emitting element.

6. A current output circuit according to claim 1, wherein the current output terminal is connected to one of an LED, a semiconductor laser, and an electron emitting element.

7. A current output circuit according to claim 1, wherein the current output terminal is connected to a surface conduction electron emitter.

8. A current output circuit according to claim 1, wherein the current output circuit is integrated in a driver circuit chip for driving a flat panel display in accordance with image data.

9. A current output circuit comprising:

a reference current source for outputting a predetermined reference current;

a plurality of current supply circuits provided for each of a plurality of current outputs, said current supply circuit including a current mirror circuit made of a pair of MOS transistors whose gate electrodes are connected in common, and a hold capacitor for holding a gate potential of the current mirror circuit, wherein one of the pair of MOS transistors samples the reference current and the other of the pair of MOS transistors supplies a drive circuit to a load;

an operational amplifier whose non-inverting input terminal is input with a predetermined reference voltage, whose inverting input terminal is input with an output voltage of the one of the pair of MOS transistors of the current mirror circuit, the output voltage being fed back via a feedback resistor, and whose output terminal is connected to the gate electrodes of the current mirror circuit; and a plurality of switching devices for selecting said plurality of current supply circuits in accordance with each load, wherein said operational amplifier controls so that a current sampled by said current supply circuit becomes equal to the predetermined reference current to supply the drive current corresponding to the sampled current to each load.

10. A current output circuit according to claim 9, wherein the predetermined reference voltage of said operational amplifier is set generally equal to a voltage across the load.

* * * * *

UNITED STATES PATENT AND TRADEMARK OFFICE

CERTIFICATE OF CORRECTION

PATENT NO. : 6,222,357 B1
DATED : April 24, 2001
INVENTOR(S) : Takamasa Sakuragi It is certified that error appears in the above-identified patent and that said Letters Patent is hereby corrected as shown below:

Column 1,
Line 37, "and" (second occurrence) should read -- an --.

Column 3,
Line 13, "comprises:" should read -- comprise: --.

Column 7,
Line 15, "connection" should read -- connecting --.

Signed and Sealed this

Fifth Day of March, 2002

*Attest:*

*Attesting Officer*

JAMES E. ROGAN
*Director of the United States Patent and Trademark Office*